US006293842B1

(12) United States Patent
Belt

(10) Patent No.: US 6,293,842 B1
(45) Date of Patent: Sep. 25, 2001

(54) CANTILEVER JET DRIVE PACKAGE HAVING MOUNTING ADAPTER WITH EXHAUST PASSAGE

(75) Inventor: Fletcher C. Belt, Woodstock, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/615,178

(22) Filed: Jul. 13, 2000

Related U.S. Application Data

(63) Continuation-in-part of application No. 09/265,075, filed on Mar. 9, 1999, now Pat. No. 6,132,269.

(51) Int. Cl.[7] ..... B63H 21/30
(52) U.S. Cl. ..... 444/111; 440/38
(58) Field of Search ..... 440/88, 89, 38, 440/111, 112

(56) References Cited

U.S. PATENT DOCUMENTS

| | | | | |
|---|---|---|---|---|
| 2,064,463 | | 12/1936 | Crosley, jr. | 115/34 |
| 3,083,679 | | 4/1963 | Conover | 115/34 |
| 3,170,435 | | 2/1965 | Najmian, Jr. | 115/34 |
| 3,259,099 | | 5/1966 | Kiekhaefer | 115/34 |
| 3,583,357 | | 6/1971 | Shimanckas | 115/41 |
| 3,742,895 | * | 7/1973 | Hoiuchi | 440/89 |
| 3,834,344 | | 9/1974 | Yoshino | 115/34 R |
| 3,888,203 | * | 6/1975 | Lohse | 440/111 |
| 3,929,089 | | 12/1975 | Lambrecht et al. | 115/41 HT |
| 5,490,768 | | 2/1996 | Veronesi et al. | 417/356 |
| 5,536,187 | | 7/1996 | Nanami | 440/38 |

* cited by examiner

*Primary Examiner*—Ed Swinehart
(74) *Attorney, Agent, or Firm*—Dennis M. Flaherty

(57) ABSTRACT

A marine vessel or watercraft in which the power plant or engine is cantilevered off of the inboard face of the transom by a mounting adapter. An inboard engine is attached to the mounting adapter. By this arrangement, the mounting adapter provides cantilevered support to the engine. The engine has at least one exhaust port for engine exhaust gases. The mounting adapter has an exhaust channel in flow communication with an exhaust port of the inboard engine. In addition, the transom has an opening in flow communication with the exhaust channel of the mounting adapter. Thus the passage in the mounting adapter provides a flow path for engine exhaust gases to pass through an opening in the hull. Optionally the exhaust channel in the mounting adapter includes a noise suppression device, e.g., a muffler.

15 Claims, 2 Drawing Sheets

CANTILEVER JET DRIVE PACKAGE HAVING MOUNTING ADAPTER WITH EXHAUST PASSAGE

RELATED PATENT APPLICATION

This application is a continuation-in-part application claiming priority from U.S. patent application Ser. No. 09/265,075 filed on Mar. 9, 1999, now U.S. Pat. No. 6,132,269.

FIELD OF THE INVENTION

This invention generally relates to inboard motors for powering water jet propulsion units in boats and other watercraft. In particular, the invention relates to inboard engines cantilevered to transoms of watercraft.

BACKGROUND OF THE INVENTION

It is known to propel a boat or other watercraft using a water jet apparatus mounted to the hull, with the powerhead placed inside (inboard) the hull and an axialflow water jet apparatus mounted outside the boat below the waterline. The drive shaft of the water jet apparatus is coupled to the crankshaft of the motor. The water jet apparatus comprises an impeller mounted on the drive shaft and a housing surrounding the impeller. The interior surface of the housing defines a water tunnel. The impeller is designed such that during motor operation, the rotating impeller impels water rearward through the water tunnel and out an exit nozzle. The reaction force of the rearward water flow exiting the jet propulsion device propels the watercraft forward.

To facilitate use of jet-propelled boats in shallow water, it is known to mount the water jet propulsion unit at an elevation such that the propulsion unit does not project below the bottom of the boat hull. This can be accomplished, for example, by installing a duct in the stern of the boat, the duct being arranged to connect one or more inlet holes formed in the bottom of the hull with an outlet hole formed in the transom. The pump jet is then installed outside the hull in a position such that the pump jet inlet is in flow communication with the duct outlet at the transom.

Typically the jet drive power plant is mounted on stringers built into the hull of a boat for in-line drive applications or on an adapter plate mounted to stringers for 90° drive applications. It is also known to mount a marine engine to the inboard or forward face of a transom in a cantilever arrangement. In such a cantilevered arrangement, it is conventional practice to provide a hole in the transom through which the engine drive shaft passes.

There is a need for a design whereby a water jet propulsion unit is powered by an engine cantilevered from the transom. The mounting arrangement should also incorporate means for venting exhaust gases from the engine to a locus below the waterline and behind the transom.

SUMMARY OF THE INVENTION

The present invention is directed to a marine vessel or watercraft in which the power plant or engine is cantilevered off of the inboard face of the transom by a mounting adapter. In accordance with the preferred embodiment of the invention, the mounting adapter is attached to the transom on the inboard side thereof, and an inboard engine is attached to the mounting adapter. By this arrangement, the mounting adapter provides cantilevered support to the engine.

In accordance with the preferred embodiment, the engine comprises at least one exhaust port for engine exhaust gases.

The mounting adapter comprises an exhaust channel in flow communication with an exhaust port of the inboard engine. In addition, the transom comprises an opening in flow communication with the exhaust channel of the mounting adapter. Thus the passage provides a flow path for engine exhaust gases to pass through an opening in the hull. Optionally the exhaust channel in the mounting adapter comprises a noise suppression device, e.g., a muffler.

Furthermore, a transom mounting plate is attached to the transom on its aft side. This transom mounting plate provides cantilevered support for a jet propulsion unit and comprises an exhaust pipe in flow communication with the opening in the transom. The exhaust pipe has an outlet which is located below the hull waterline. In accordance with the preferred embodiment, the transom mounting plate further comprises a tube portion having an inlet in flow communication with a water tunnel formed in the hull and an outlet in flow communication with an inlet of the jet propulsion unit. Preferably the exhaust pipe or manifold branches into two exhaust pipes which straddle the tube portion.

Preferably, each of the transom mounting plate and the mounting adapter is a cast metal structure. Also the transom mounting plate and the mounting adapter are preferably attached to the transom (on opposite sides thereof) by the same set of fasteners, with the transom sandwiched therebetween. The shafts of the fasteners are preferably encased in rubber isolation mounts to prevent the transmission of vibrations from the engine to the transom and the transom mounting plate.

DETAILED DESCRIPTION OF THE PREFERRED EMBODIMENTS

Figure 1:
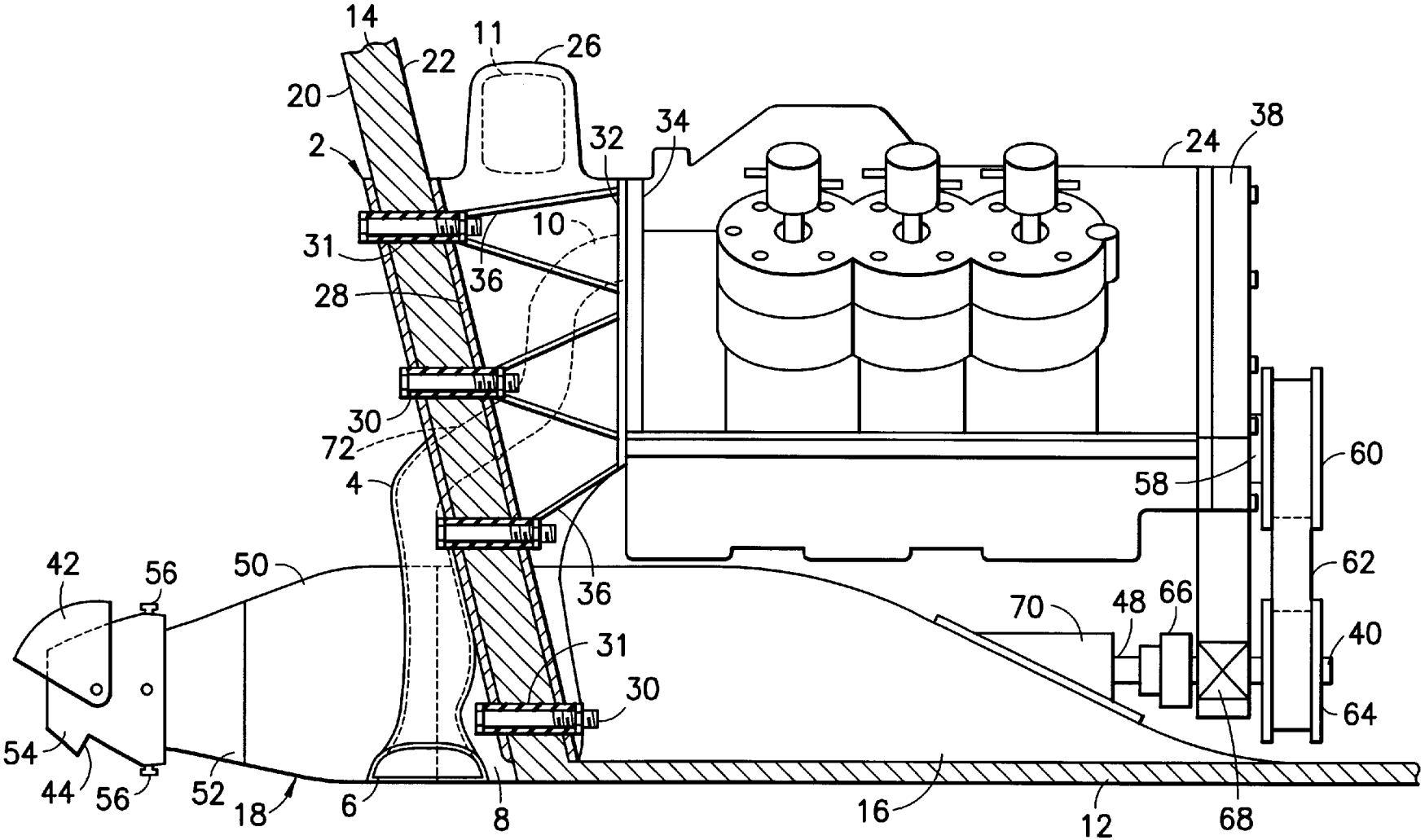
FIG. 1 is a schematic showing an elevational partly sectional view of the stern of a jet-powered watercraft in accordance with the preferred embodiment of the invention.

Referring to FIG. 1, there is shown in cross section a molded hull 10 of a marine vessel having a bottom hull portion 12 extending from a transom portion 14 to a forward bow of the boat (not shown). As shown, the hull bottom 12 is attached to the transom 14 in a fluid-tight manner. The hull bottom 12 has a water inlet (not shown) which communicates with a channel or tunnel 16 formed as part of the molded hull. The bottom of a portion of the tunnel can be closed by a bolted-on inlet structure having a built-in grate (not shown). The other end of the tunnel 16 communicates with an inlet opening of a conventional water jet propulsion unit 18, mounted aft of the transom by means of a transom mounting plate 2 attached to an aft face 20 of the transom 14.

The transom mounting plate 2 (shown in FIG. 2) is preferably a sand-cast metal structure comprising a plate, a tube portion 8 connected at one end to a lower portion of the plate, and an exhaust manifold 4 which branches into separate pipes that straddle the tube portion 8. The ends of the exhaust pipes are open to form respective exhaust outlets 6. The aft end of the tube portion 8 is provided with conventional means (e.g., a flange with threaded holes) for attaching a water jet propulsion unit.

Referring again to FIG. 1, the tube portion 8 effectively becomes an extension of the water duct or tunnel 16, i.e., is in flow communication with the water duct 16. Preferably the shape of the tube portion 8, at the inlet where it meets the water duct 16, should conform to the shape of the latter, thereby allowing water to flow along a smooth transition from the water duct 16 into the tube portion 8. Similarly, the inlet to the water jet propulsion unit 18 is in flow communication with the outlet of tube portion 8. Thus tube portion 8 of the transom mounting plate 2 guides flowing water from the water duct 16 into the jet propulsion unit.

One conventional type of water jet propulsion unit comprises an impeller (not shown) mounted to a drive shaft 48 and a housing 50 surrounding the impeller. The impeller draws in ambient water via the duct 16 and the water inlet (not shown) of that duct, formed in the hull bottom 12. The water inlet is preferably covered by a grating or screen (not shown) to prevent debris from entering the duct 16, thereby avoiding damage to the impeller inside the water jet propulsion unit 18. The impeller housing 50 is in flow communication with a thrust nozzle 52 having a decreasing cross-sectional area to increase the velocity of the impelled water passing therethrough. A steering nozzle 54 is pivotally mounted to the thrust nozzle by means of a pair of pivot pin assemblies 56. The water flow exiting the steering nozzle 54 can be reversed by activation of a conventional reverse gate 42, which causes exiting water to flow through a slot 44 formed in the steering nozzle 54 and in a reverse direction. The steering and shifting controls for controlling the positions of the steering nozzle and the reverse gate comprise well-known structures such as cables, links and levers. These structures are not shown in the drawings to avoid unnecessary complication in the depiction of the preferred embodiment.

As shown in FIG. 1, the water jet propulsion unit is powered by a powerhead or engine 24. The engine 24 may be any suitable power source, such as a gasoline or diesel internal combustion engine. The engine could be a 2-cycle or a 4-cycle engine which has the necessary power for driving the boat. As shown, at the forward end of engine 24, there is included a drive plate assembly 35 which is coupled to a crankshaft 58 of engine 24. Drive plate assembly 35 extends below the bottom of the engine 24 as shown and provides a drive output 40 at a point below the engine, namely the forward end of the drive shaft 48, the rear end of which is coupled to the impeller. It will be appreciated that the crankshaft 58 of the engine 24 may be coupled to the drive output 40 by any suitable transmission technique, including a fixed ratio belt drive, such as indicated by pulleys 60 and 64 which are connected by belt 62. It will also be appreciated by those skilled in the art that a fixed ratio gear drive could readily be substituted for the fixed ratio belt drive. Further, it is also possible to use a changeable ratio gear drive or a continuous variable transmission for transferring the power from the crankshaft 58 of the engine 24 to the drive output 40. There may also be included in any of the above-mentioned drive mechanisms an electric clutch such that the engine and transmission include a neutral setting.

In accordance with a further feature of the preferred embodiment, the drive shaft 48 is rotatably supported by a bearing 68 incorporated in the drive plate assembly and is isolated from the vibrations produced by the operating engine by means of an isolation coupler 66 which damps and vibrations. In addition, a watertight seal assembly 70 allows leakage-free passage of the drive shaft 48 through the hull of the boat. As a result, when the engine 24 is operating and power is being transmitted to drive shaft 48 from drive output 40 through isolation coupler 66, water will be drawn into the duct or passage 16 and then impelled out the steering nozzle 54 by the impeller of the jet propulsion unit 18.

In accordance with the preferred embodiment of the invention, the engine 24 is cantileverly mounted to the transom 14 by means of a mounting adapter 26, which is attached to the inboard face 22 of the transom by means of a multiplicity of fastener assemblies 30 (e.g., a nut and bolt assembly) which penetrate the transom 14 at different elevations. The mounting adapter 26 is preferably a sandcast metal structure designed to support the engine in cantilever fashion. Preferably the mounting adapter has a pair of transom mounting flanges 28 (only one of which is visible in FIG. 1) on opposing sides of the adapter. Each transom mounting flange 28 has a plurality of holes which align with corresponding holes 10 (seen in FIG. 2) formed in the transom mounting plate 2, as well as with corresponding holes formed in the transom 14. Thus, it should be apparent that each fastener 30 passes through a transom mounting flange 28 of the mounting adapter 26, the transom 14, and the transom mounting plate 2. These fastener assemblies fasten the mounting adapter 26 to the inboard face 22 of the transom and fasten the transom mounting plate 2 to the aft face 20 of the transom, sandwiching the transom therebetween.

Preferably the mounting adapter is designed to have a shape to assure that the engine 24 is maintained in a horizontal position. The mounting adapter 26 is cast with a pair of engine mounting flanges 32 (only one of which is visible in the figure). Similarly, the engine 24 is provided with a pair of mounting flanges 34 (again, only one is visible). The aft end of the engine is mounted to the forward face of the mounting adapter by fastening the flanges 34 of the engine to the respective engine mounting flanges 32 using fasteners (not shown).

In addition, the mounting adapter 26 is designed with a plurality of external reinforcement ribs 36, which extend from bosses formed on the transom mounting flanges 28. These bosses surround and reinforce the holes in the transom mounting flanges which are penetrated by the fasteners 30. To help prevent vibrations of the engine being transmitted to the boat, rubber mounts 31 are installed in the penetration holes in the transom 14, which rubber mounts are in turn surround the shaft of the bolts passing therethrough. Thus it can be seen that the engine or power source 24 is cantileverly mounted to the transom 14.

Figure 2:
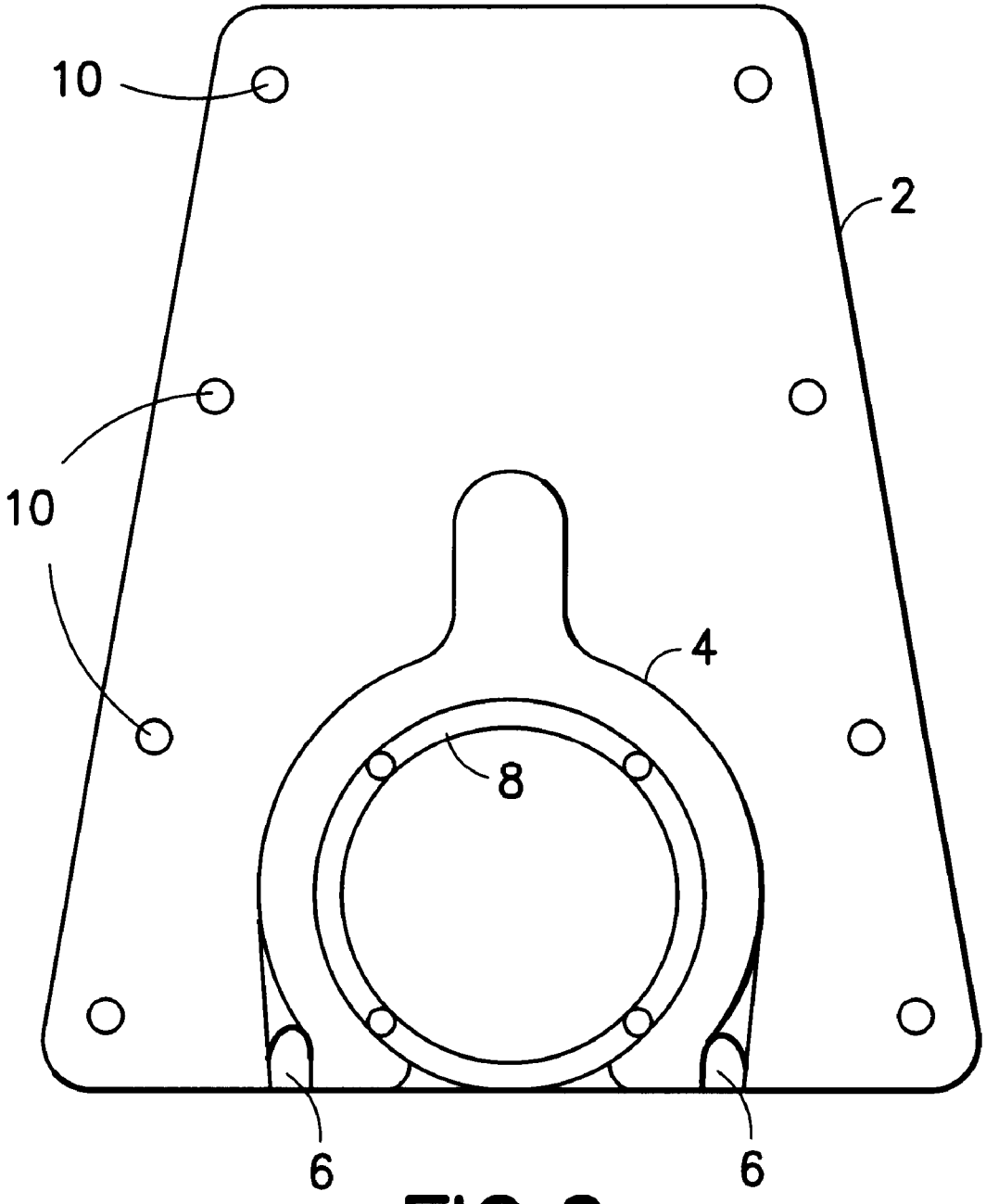
FIG. 2 is a schematic showing a rear elevational view of a transom mounting plate incorporated in the watercraft depicted in FIG. 1.

In addition to providing cantilevered support for the engine, the mounting adapter is also designed to serve as an exhaust manifold. In accordance with the preferred embodiment of the invention, an exhaust port of the engine is in flow communication with an opening 72 in the transom via a flow passage or channel 10 formed when the mounting adapter is cast. If the engine has more than one exhaust port, then an equal number of branches can be provided. In the latter case, the branches meet to form a single main channel in flow communication with the transom opening 72. In accordance with a further preferred embodiment, a muffler 11 can be built into the mounting adapter to suppress engine noise. Although not shown in FIG. 1, the person skilled in the art will readily appreciate that the inlet of the muffler 11 must be in flow communication with the engine exhaust port (or ports) via a first passage (or respective passages) formed in the mounting adapter, while the outlet of the muffler will be in flow communication with the transom opening 72 via a second passage In accordance with the preferred embodiment of the invention, the transom mounting plate 2 is also designed to play a role in the exhaustion of exhaust gases from the engine. More particularly, the transom mounting plate 2 comprises an exhaust manifold 4 having an inlet in flow communication with the transom opening 72. As best seen in FIG. 2, the exhaust manifold 4 starts as a single pipe and then branches into a pair of exhaust pipes which straddle the tube portion (and the portion of the jet propulsion unit connected thereto). As best seen in FIG. 1, each exhaust pipe of exhaust manifold 4 has an exhaust outlet 8 which is located at an elevation below the centerline of the jet propulsion unit, i.e., the exhaust outlets 6 will be disposed below the waterline when the vessel is waterborne.

Thus, the preferred embodiments of the invention provide an engine exhaust system for a cantilever-mounted inboard engine which is easy to build and requires a minimum of connections.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A watercraft comprising:

a hull comprising a transom having inboard and aft sides, wherein said transom comprises an opening;

a mounting adapter comprising a mounting flange attached to said transom on said inboard side and an exhaust channel having one end in flow communication with said opening in said transom;

an inboard power plant supported in cantilever fashion from said mounting adapter, said inboard power plant comprising a mounting flange attached to said mounting adapter and comprising an exhaust port for engine exhaust gases, said exhaust port being in flow communication with another end of said exhaust channel of said mounting adapter;

a transom mounting plate attached to said transom on said aft side, said transom mounting plate comprising an exhaust pipe in flow communication with said exhaust port of said inboard power plant via said exhaust channel in said mounting adapter and said opening in said transom;

an outboard propulsion unit attached to said transom mounting plate; and a drive train for coupling said outboard propulsion unit to said inboard power plant.

2. The watercraft as recited in claim 1, wherein said exhaust channel in said mounting adapter comprises a noise suppression device.

3. The watercraft as recited in claim 1, wherein said transom mounting plate and said mounting adapter are attached to said transom by the same set of fasteners which penetrate said transom.

4. The watercraft as recited in claim 1, wherein each of said transom mounting plate and said mounting adapter is a cast metal structure.

5. A watercraft comprising a hull with a transom having an opening, an engine mounting adapter attached to said transom, an inboard engine attached to said engine mounting adapter and having an exhaust port, and an outboard propulsion unit driven by said inboard engine, wherein said engine mounting adapter comprises a cast metal structure designed to provide cantilevered support for said engine when said cast structure is attached to said transom, wherein said cast metal structure comprises a front face and a rear face, a first mounting flange adjacent said front face and a second mounting flange adjacent said rear face, and a passage having an opening on said front face which abuts said transom opening and an opening on said rear face which abuts said engine exhaust port.

6. A watercraft comprising a hull with a transom having an opening, an engine mounting adapter attached to said transom, an inboard engine attached to said engine mounting adapter and having an exhaust port, and an outboard propulsion unit driven by said inboard engine, wherein said engine mounting adapter comprises a passage having a first opening abutting said transom opening and a second opening abutting said engine exhaust port, said hull comprises a water tunnel, and said outboard propulsion unit comprises an impeller mounted to a shaft driven to rotate by said engine and an impeller housing surrounding said impeller to form a duct in flow communication with said water tunnel.

7. The watercraft as recited in claim 6, wherein said engine mounting adapter comprises a cast metal structure designed to provide cantilevered support for said engine when said cast structure is attached to said transom.

8. The watercraft as recited in claim 6, wherein said engine mounting adapter further comprises a noise suppression device installed in said passage.

9. The watercraft as recited in claim 6, further comprising an exhaust pipe external to said hull and having a first opening abutting said transom opening and a second opening located below a waterline of said hull.

10. The watercraft as recited in claim 6, further comprising a mounting plate attached to said transom and a tube portion connected to said mounting plate and in flow communication with said water tunnel, said impeller housing being mounted to and in flow communication with said tube portion.

11. A watercraft comprising a hull with a transom, an engine mounting adapter attached to said transom, an inboard engine attached to said engine mounting adapter and having an exhaust port, and an outboard jet propulsion unit driven by said inboard engine, wherein said engine mounting adapter comprises a passage having a first opening abutting said engine exhaust port and provides cantilevered support for said inboard engine, said hull comprises a water tunnel, and said outboard propulsion unit comprises an impeller mounted to a shaft driven to rotate by said engine and an impeller housing surrounding said impeller to form a duct in flow communication with said water tunnel.

12. The watercraft as recited in claim 11, wherein said transom has an opening, and said passage of said engine mounting adapter has a second opening abutting said transom opening.

13. The watercraft as recited in claim 11, wherein said engine mounting adapter further comprises a noise suppression device installed in said passage.

14. The watercraft as recited in claim 12, further comprising an exhaust pipe external to said hull and having a first opening abutting said transom opening and a second opening located below a waterline of said hull.

15. The watercraft as recited in claim 11, further comprising a mounting plate attached to said transom and providing cantilevered support for said jet propulsion unit and means for coupling said engine to said jet propulsion unit.

* * * * *